US005794765A

United States Patent [19]

Zhen

[11] Patent Number: 5,794,765

[45] Date of Patent: Aug. 18, 1998

[54] ELECTRIC CONNECTOR ASSEMBLY

[76] Inventor: Jun-Hsiung Zhen, No. 7, Alley 67, Lane 168, Feng-Dung Road, Feng-Yuan City, Taichung County, Taiwan

[21] Appl. No.: 747,672

[22] Filed: Nov. 12, 1996

[51] Int. Cl.[6] ..... H01H 15/06

[52] U.S. Cl. ..... 200/550; 200/549

[58] Field of Search ..... 200/550, 549, 200/547, 16 R, 16 A, 548, 16 C, 16 D

[56] References Cited

U.S. PATENT DOCUMENTS 5,153,401 10/1992 Tseng ..... 200/550

5,322,983 6/1994 Tseng ..... 200/550

*Primary Examiner*—David J. Walczak

*Attorney, Agent, or Firm*—Morton J. Rosenberg; David I. Klein; Jun Y. Lee

[57] ABSTRACT

An electric connector assembly includes a housing, a slide block mounted in the housing, and a plug-in device mounted in the housing at a position above the sliding block. The plug-in device includes a fixing seat having two first receiving compartments and a second receiving compartment defined in each of two sides thereof. The fixing seat further includes four first accesses and two second accesses defined in an upper side thereof which are in communication with the first receiving compartments and the second receiving compartments, respectively. A first conductive plate is mounted in each first receiving compartment, and a second conductive plate mounted in each second receiving compartment. A third conductive plate is mounted in the housing for electrically interconnecting each second conductive plate and the associated first conductive plate. The first conductive plates are selectively in electrical connection with one of first conductive members and second conductive members formed on the sliding block upon manual operation of the sliding block.

4 Claims, 13 Drawing Sheets

ELECTRIC CONNECTOR ASSEMBLY

BACKGROUND OF THE INVENTION

1. Field of the Invention

The present invention relates to improved electric connector assemblies which can be easily assembled due to their having simple structures and which can be easily connected with electric wires. The present invention also relates to improved electric connector assemblies which have a low manufacture cost.

2. Description of the Related Art

A typical direction-control switch for motors is shown in FIG. 13 of the drawings. The switch includes a positioning plate 50, a slide block 40 mounted in the positioning plate 50, and an insulating board 60. The positioning plate 50 is U-shaped in section and includes a slot 51 defined in a bottom thereof and a pair of retaining pieces 52 formed on an upper end of each of two lateral walls thereof. The sliding block 40 includes two recesses 41 defined in an upper side thereof each for receiving a resilient conductive plate 42 therein. The sliding block 40 further includes an operative rod 43 projecting downwardly from an underside thereof and extending through the slot 51. The insulating board 60 includes six prongs 61 on an upper side thereof and six corresponding contacts (not shown) provided on an underside thereof and electrically connected to the associated prongs 61.

In assembly, the conductive plates 42 are inserted into the associated recesses 41 of the sliding block 40 which is then mounted to an interior of the positioning plate 51 with the operative rod 43 extending through the slot 51. Thereafter, the insulating board 60 is mounted above the sliding block 40 in a manner that the conductive plates 42 contact with four of the six contacts, wherein the retaining pieces 52 are bent inwardly to retain the insulating board 60 in position. Generally, each prong 61 has a hole defined in a distal end thereof for electrical connection with a capacitor, a control device, and a motor via an electric wire. The free end of the electric wire is firstly twisted to wind the thin cables thereof together and is then extended through the hole in the prong 61. Thereafter, soldering is applied and the electric wire is wound around the distal end of the associated prong 61, thereby securing the electric wire to the prong 61. Nevertheless, the processing is time consuming, and defective soldering as well as electric leakage often occur. In order to prevent electric leakage, an insulating cap 62, preferably made from polyvinyl chloride (PVC), is provided to enclose the electric wire and the prong 61, yet, the assembly thereof is time-consuming and difficult since an outer diameter of the electric wire is approximately the same as an inner diameter of the insulating cap. In addition, electricity leakage and electric shock still might occur in the exposed area of the connection between the electric wire and the prong 61 if the cap is not securely mounted. A further drawback of the above-mentioned structure is that the whole processing is time-consuming and complicated.

U.S. Pat. No. 5,529,516 to Applicants discloses a connector which includes one or more sockets engaged in a body for electrically connecting electric members together. The sockets each include one side surface having two rooms for receiving contacts, and includes an upper surface and a lower surface each having two orifices for communicating with the rooms. One or more U-shaped conductors may engage with the contacts of the sockets so as to electrically connect the contacts together. As a result, the electrical members may be easily connected with each other without soldering processes. The present invention is intended to provide improved designs in this regard.

SUMMARY OF THE INVENTION

In accordance with one aspect of the invention, an electric connector assembly comprises a housing including a slot defined in a bottom thereof, a slide block mounted in the housing, and a plug-in device mounted in the housing at a position above the sliding block. The slide block includes an operative rod projecting downwardly from an underside thereof and extending through the slot of the housing. The slide block further includes two separate first conductive members and two separate second conductive members mounted to an upper side thereof.

The plug-in device includes a fixing seat having two first receiving compartments and at least one second receiving compartment defined in each of two sides thereof. The fixing seat further includes four first accesses and at least two second accesses defined in an upper side thereof which are in communication with the first receiving compartments and the second receiving compartments, respectively.

A first conductive plate is mounted in each first receiving compartment, and a second conductive plate is mounted in each second receiving compartment. In addition, a third conductive plate is mounted in the housing for electrically interconnecting one of the second conductive plates and the associated first conductive plate.

Each first conductive plate includes a first end attached to the third conductive plate and a second end which extends through a bottom wall defining the associated first receiving compartment and bearing against the bottom wall defining the associated first receiving compartment. The second ends of the first conductive plates are selectively in electrical connection with one of the first conductive members and the second conductive members upon manual operation of the sliding block via the operative rod. The first conductive members are substantially U-shaped and disposed in mirror image, and the second conductive members are substantially rectangular and disposed in parallel relationship one with respect to another.

The housing may include a plurality of engaging slots defined in an upper end of each of two lateral walls thereof, and the fixing seat may include a plurality of hooks formed on two lateral sides thereof for being securely received in the engaging slots.

The bottom wall defining each first receiving compartment includes a recess defined therein, and the second end of each first conductive plate includes a hook end which is securely retained in the recess. Preferably, each first conductive plate is substantially S-shaped and the first end thereof bears against a wall defining part of the associated first receiving compartment. Preferably, each second conductive plate is substantially S-shaped and the first end thereof bears against the associated third conductive plate.

In accordance with another aspect of the invention, an electric connector assembly comprises a housing including a slot defined in a bottom thereof, a slide block mounted in the housing, and a plug-in device mounted in the housing at a position above the sliding block. The slide block includes an operative rod projecting downwardly from an underside thereof and extending through the slot of the housing. The slide block further includes a first conductive member and a second conductive member mounted to an upper side thereof.

The plug-in device includes a positioning box mounted in the housing and including an open upper end. A fixing seat includes a first fixing block and a second fixing block which are received in the positioning box. The first fixing block and the second fixing block respectively have four and two receiving compartments defined therein. The first fixing block and the second fixing block further respectively include four and two accesses defined in upper sides thereof which are in communication with the associated receiving compartments, respectively.

A conductive plate is mounted in each receiving compartment. Each conductive plate includes a first end bearing against a wall defining part of the associated receiving compartment and a second end which extends through a bottom wall defining part of the associated receiving compartment and bearing against the bottom wall. Upon manual operation of the sliding block via the operative rod, four of the six second ends of the conductive plates are in electrical connection with one of the first conductive member and the second conductive member, and the remaining two of the six second ends of the conductive plates are in electrical connection with the other of the first conductive member and the second conductive member.

In a modified embodiment of the invention, a third fixing block may be received in the positioning box. The third fixing block may have two second receiving compartments each for receiving a second conductive plate therein. The second conductive plate is substantially S-shaped and has a first end and a second end bearing against a wall defining part of the associated second receiving compartment. The third fixing block further includes two second accesses which are defined in an upper side thereof and in communication with the associated second receiving compartments, respectively. The third fixing block may further include two third accesses defined in a lateral wall thereof and in communication with the second receiving compartment.

In another modified embodiment of the invention, the first fixing block may further comprise an extension block formed on a lateral side thereof, the extension block including a second receiving compartment therein for receiving a substantially S-shaped second conductive plate therein. The extension block further includes two second accesses defined in an upper side thereof and in communication with the second receiving compartment.

Preferably, the first conductive member is substantially U-shaped and the second conductive member is substantially rectangular. The housing includes a plurality of engaging slots defined in an upper end of each of two lateral walls thereof, and the positioning box includes a plurality of hooks formed on two lateral sides thereof for being securely received in the engaging slots.

Other objects, advantages, and novel features of the invention will become more apparent from the following detailed description when taken in conjunction with the accompanying drawings.

DESCRIPTION OF THE PREFERRED EMBODIMENTS

Figure 1:
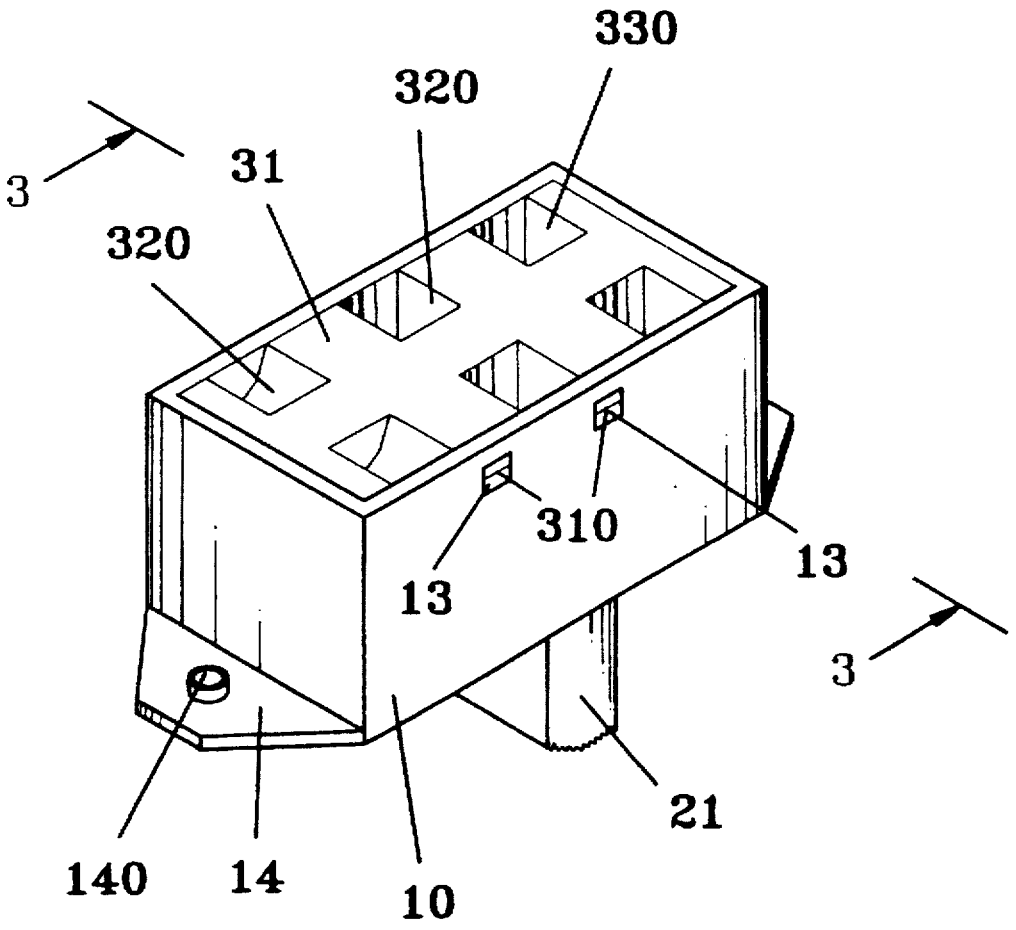
FIG. 1 is a perspective view of a first embodiment of an electric connector assembly in accordance with the present invention.

Referring to FIGS. 1 to 12 and initially to FIGS. 1 to 4, a first embodiment of an electric connector assembly in accordance with the present invention includes a housing 10, a slide block 20, and a plug-in device 30. The housing 10 includes an open upper end 11 and a slot 12 defined in a bottom thereof (see FIG. 1). The housing 10 also includes a pair of engaging slots 13 defined in an upper end of each of two lateral walls thereof. In addition, an extension plate 14 projects outwardly from each of two bottom edges of the housing 10, each extension plate 14 having a through hole 140 defined therein.

Figure 2:
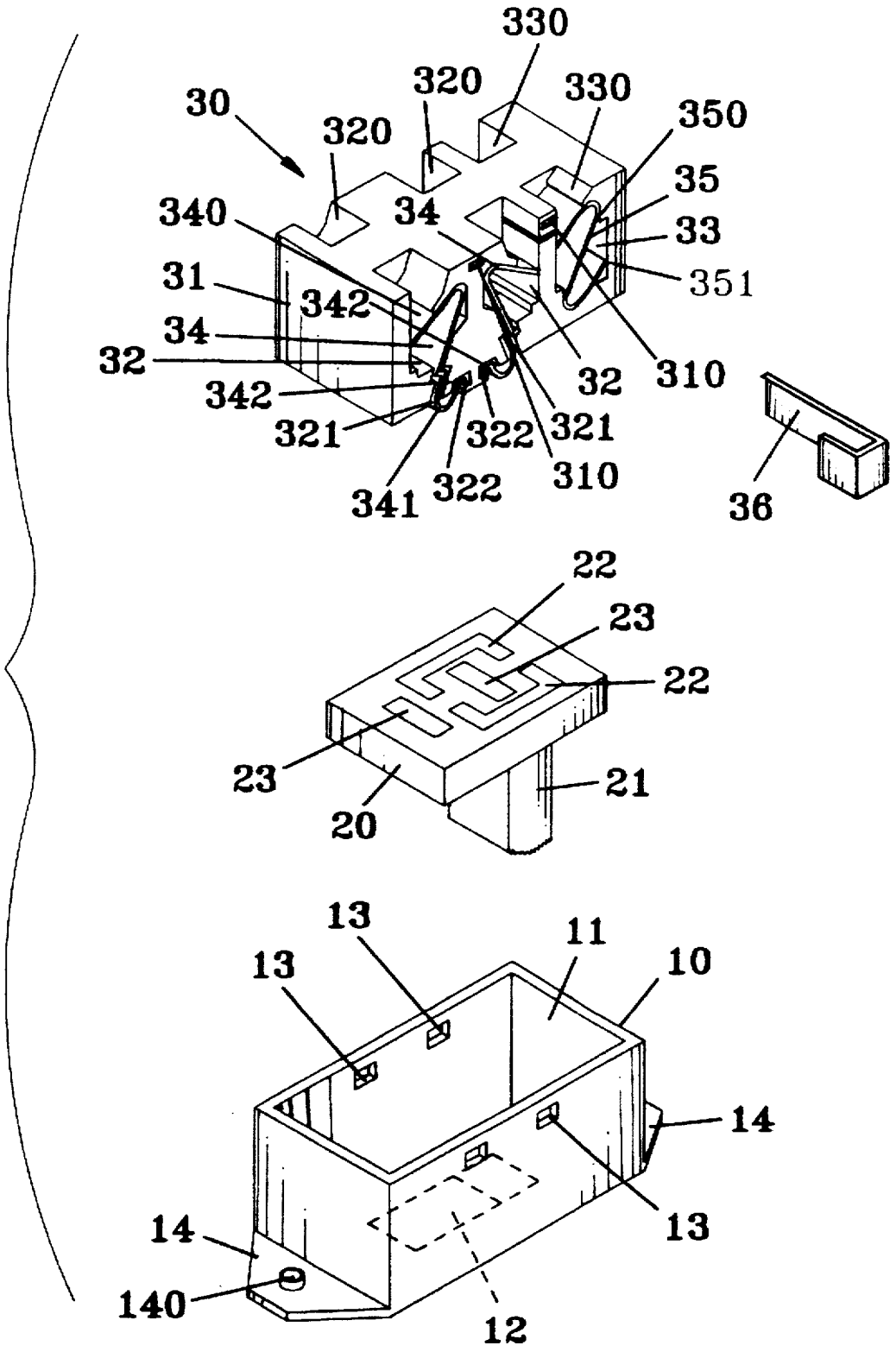
FIG. 2 is an exploded view of the electric connector assembly in FIG. 1.
Figure 3:
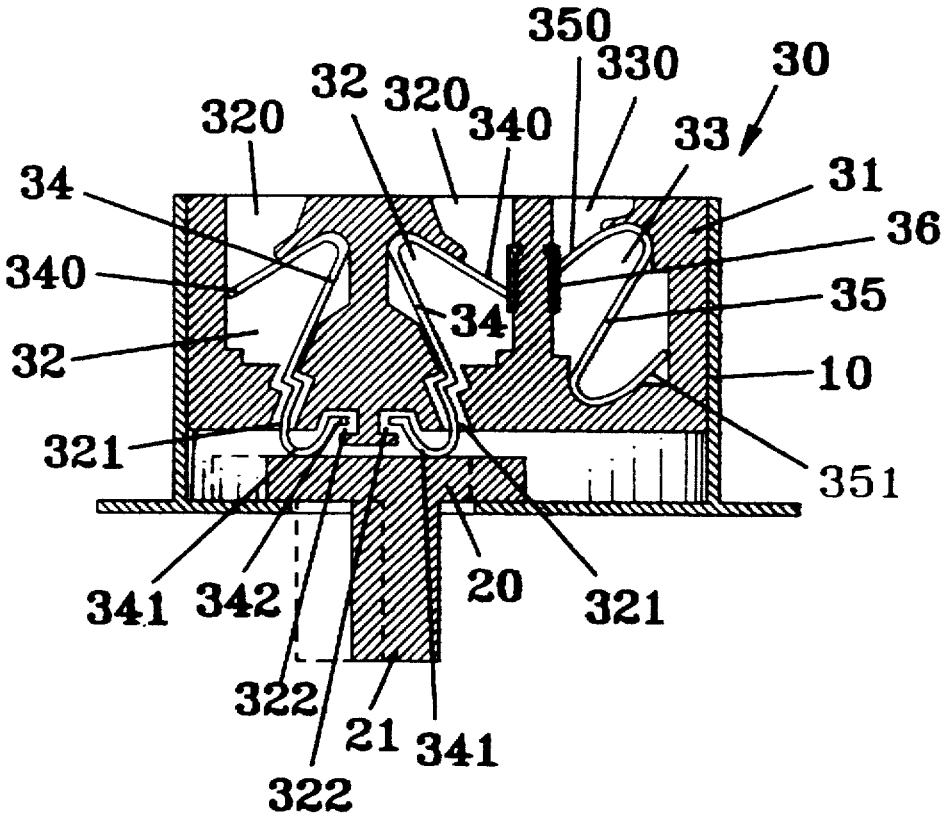
FIG. 3 is a cross sectional view taken along plane 3—3 in FIG. 1.

The plug-in device 30 includes a fixing seat 31 having two first receiving compartments 32 and a second receiving compartment 33 defined in each of two sides thereof, as shown in FIGS. 2 and 3. Four first accesses 320 are defined in an upper side of the fixing seat for being in communication with the first receiving compartments 32, respectively. Similarly, two accesses 330 are defined in the upper side of the fixing seat 31 for being in communication with the second receiving compartments 33, respectively.

A first conductive plate 34 is mounted in each first receiving compartment 32, and a second conductive plate 35 is mounted in each second receiving compartment 33. As shown in FIGS. 2 and 3, a third conductive plate 36 includes a first end mounted to a wall defining one of the second receiving compartments 33 and a second end mounted to a wall defining the associated first receiving compartment 32. As shown in FIG. 3, each second conductive plate 35 is substantially S shaped in section and includes a first end 350 attached to the first end of the third conductive plate 36 and a second end 351 bearing against a peripheral wall of the second receiving compartment. Each first conductive plate 34 includes a first end 340 and a second end 341 which extends through a bottom wall defining the second receiving compartment 32 and then retained in a recess 322 defined in the bottom wall by a distal hook end 342 thereof. End 340 of one first conductive plate 34 is attached to the second end of the third conductive plate 36, and end 350 of the associated second conductive plate 35 is attached to the first end of third conductive plate 36.

Figure 4:
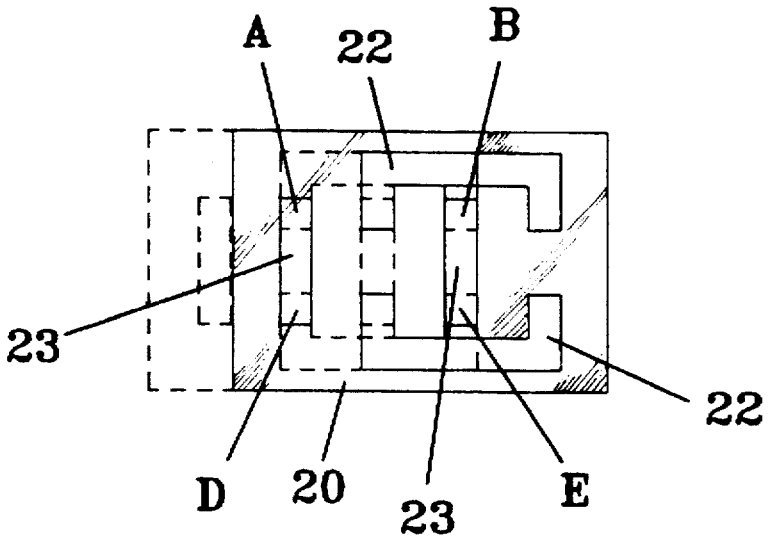
FIG. 4 is a schematic illustration of switching operation of the electric connector assembly in FIG. 1.

Referring to FIGS. 2 to 4, two separate first conductive members 22 and two separate second conductive members 23 are mounted to an upper side of the slide block 20, wherein the first conductive members 22 are substantially U-shaped and disposed in mirror image, and the second conductive members 23 are substantially rectangular and disposed in parallel relationship one with respect to another. In addition, an operative rod 21 extends downwardly from an underside of the slide block 20.

In assembly, the first conductive plates 34 and the second conductive plates 35 are respectively mounted in the associated first receiving compartments 32 and the second receiving compartments 33 in a manner shown in FIG. 3. The slide block 20 is then mounted into a bottom of the housing 10 with the operative rod 21 extending through the slot 12 defined in the housing 10. Thereafter, the plug-in device 30 is inserted into the housing 10 at a position above the slide block 20 such that the second end 341 of each first conductive plate 34 is in electrical connection with the associated first conductive member 22, i.e., a contact "A" is in electrical connection with a contact "B", while a contact "D" is in electrical connection with a contact "E", as shown in FIG. 4. The plug-in device 30 is securely retained in the housing 10 by means of, e.g., two hooks 310 (provided on each lateral wall of the plug-in device 30) snapping into the associated engaging slots 13 defined in the housing 10.

Referring to FIGS. 3 and 4, when a motor equipped with the electric connector assembly of the present invention is intended to rotate in, e.g., counterclockwise direction, the slide block 20 (via operation of the operative rod 21) is slid to a first position where the contact "A" is in electrical connection with the contact "B", while the contact "D" is in electrical connection with the contact "E", i.e., the second ends 341 of the first conductive plates 34 are in electrical connection with the associated first conductive members 22.

When the motor is intended to rotate in a reverse direction, i.e. a clockwise direction, the slide block 20 (via operation of the operative rod 21) is slid to a second position where the contact "A" is in electrical connection with the contact "D", while the contact "B" is in electrical connection with the contact "E", i.e., the second ends 341 of the first conductive plates 34 are in electrical connection with the associated second conductive members 23.

It is appreciated that the second conductive plates 35 do not provide any function when applied to a motor. Nevertheless, when applied to a ceiling fan, free ends of the electric wires of the ceiling fan may be inserted into the first and second receiving compartments 32 and 33 in sequence via the accesses 320 and 330 thereof, and then retained in position between the first end 340 of the first conductive plate 34 and the second end of the third conductive plate 36, and between the first end 350 of the second conductive plate 35 and the first end of the third conductive plate 36. This can be accomplished by simple clipping of the free ends of the electric wires between the associated elements.

Figure 5:
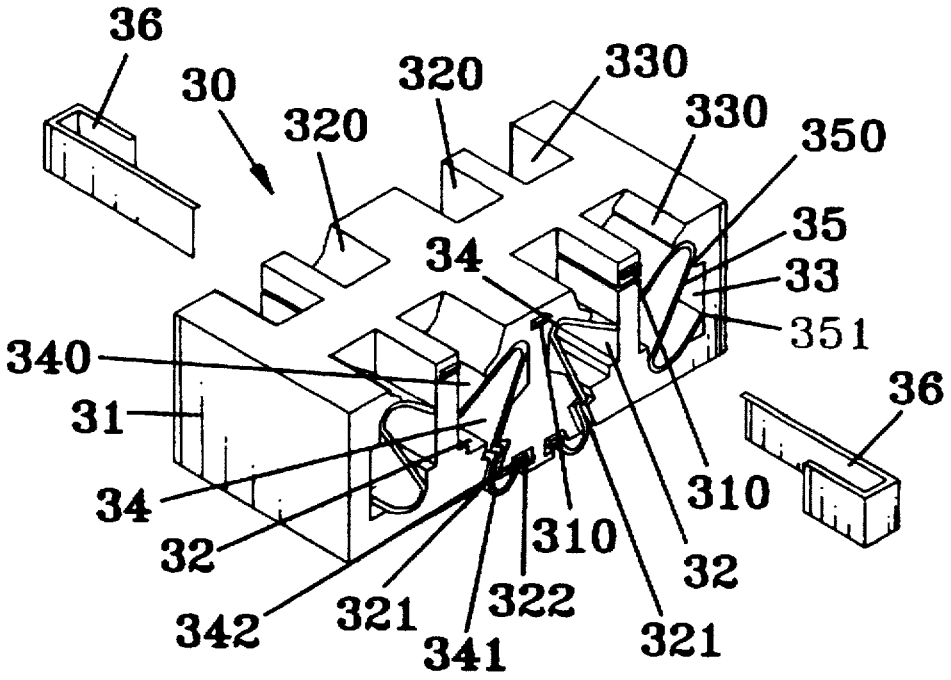
FIG. 5 is a perspective view, partially exploded, of another embodiment of a mounting seat of the electric connector assembly.
Figure 6:
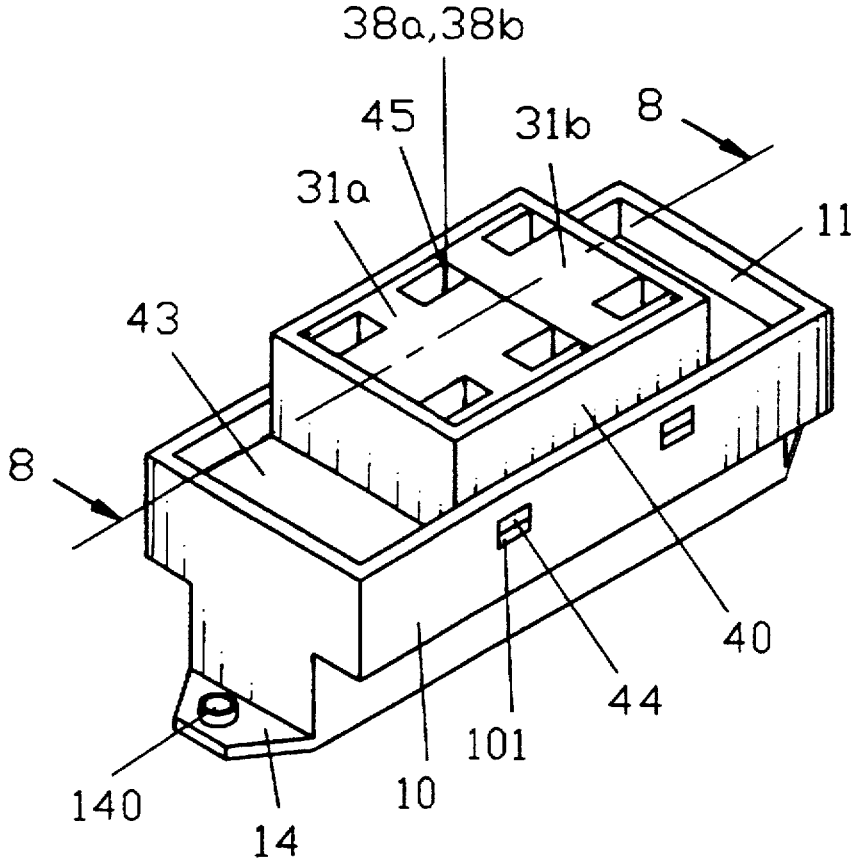
FIG. 6 is a perspective view of a second embodiment of an electric connector assembly in accordance with the present invention.

Referring to FIG. 5, the fixing seat 31 may further include two additional second conductive plates 35 mounted in a left side thereof (c.f. FIG. 2), and an additional third conductive plate 36 is provided to provide electrical connection between the associated conductive plates 35 and 34 received in the associated receiving compartments. This arrangement provides additional sockets for electrical connection with plugs, electric wires, or the like.

Figure 13:
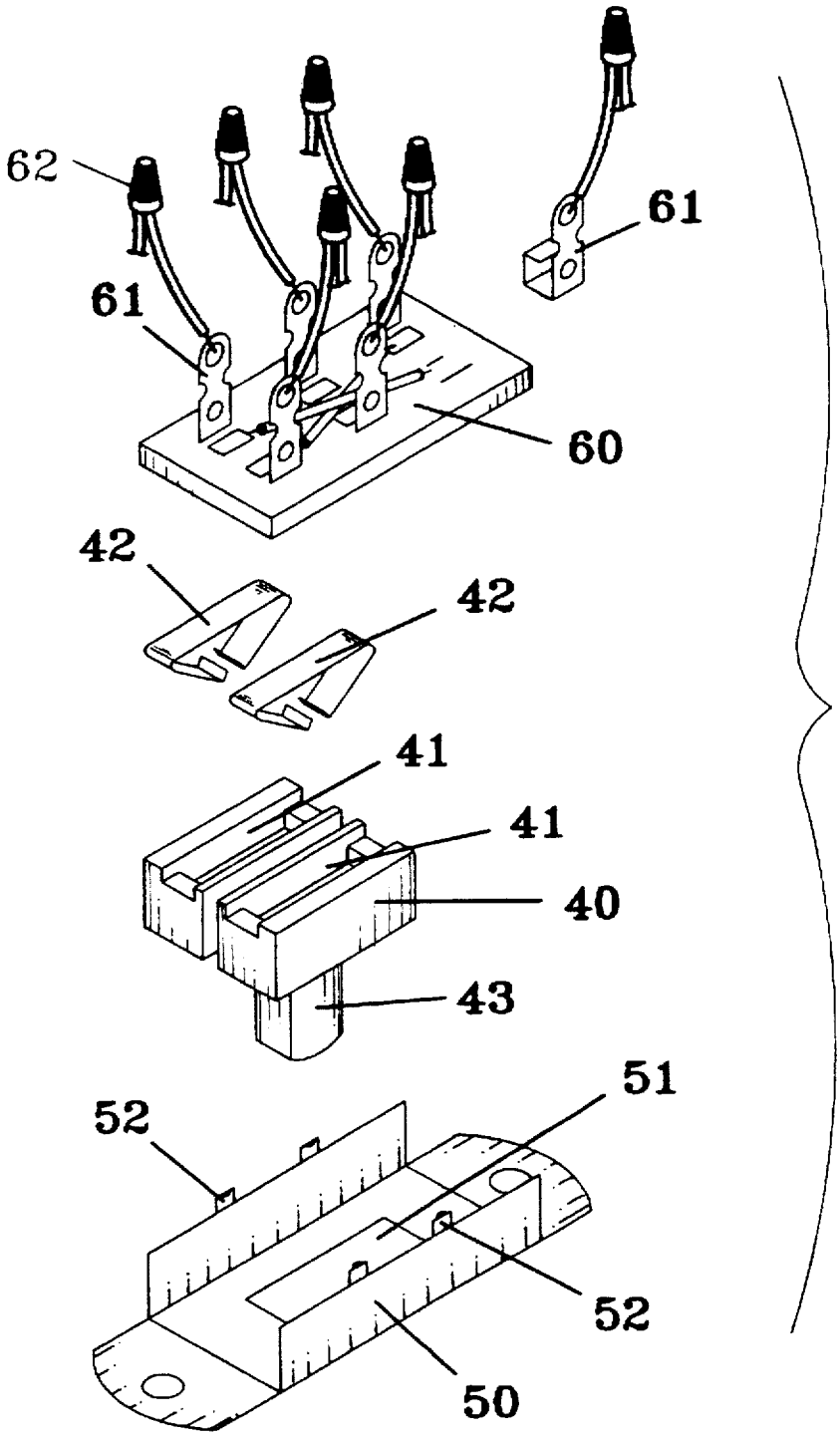
FIG. 13 PRIOR ART
FIG. 13 is an exploded perspective view illustrating a conventional switch connected to wires.

Thus, the first embodiment of the present invention is simple in structure and can be easily assembled without troublesome processing required in conventional designs (such as insertion of the conductive plates 42 into the slide block, insertion of the prongs 61 in the insulating board 60, and bending of the retaining pieces 52, see FIG. 13). In addition, the first and second conductive plates 34 and 35 have already been inserted into the fixing seat 31 such that external electric wires can be conveniently inserted into the fixing seat 31 via the accesses 320 and 330 for electrical connection with the first and second conductive plates 34 and 35, which may save time in assembly.

Referring to FIGS. 6 to 9, a second embodiment of an electric connector assembly in accordance with the present invention includes a housing 10, a slide block 20, and a plug-in device 30. The housing 10 includes an open upper end 11 and a slot 12 (see FIG. 8) defined in a bottom thereof. The housing 10 also includes a pair of engaging slots 13 defined in an upper end of each of two lateral walls thereof (see FIG. 7). In addition, an extension plate 14 projects outwardly from each of two bottom edges of the housing 10, each extension plate 14 having a through hole 140 defined therein.

Figure 7:
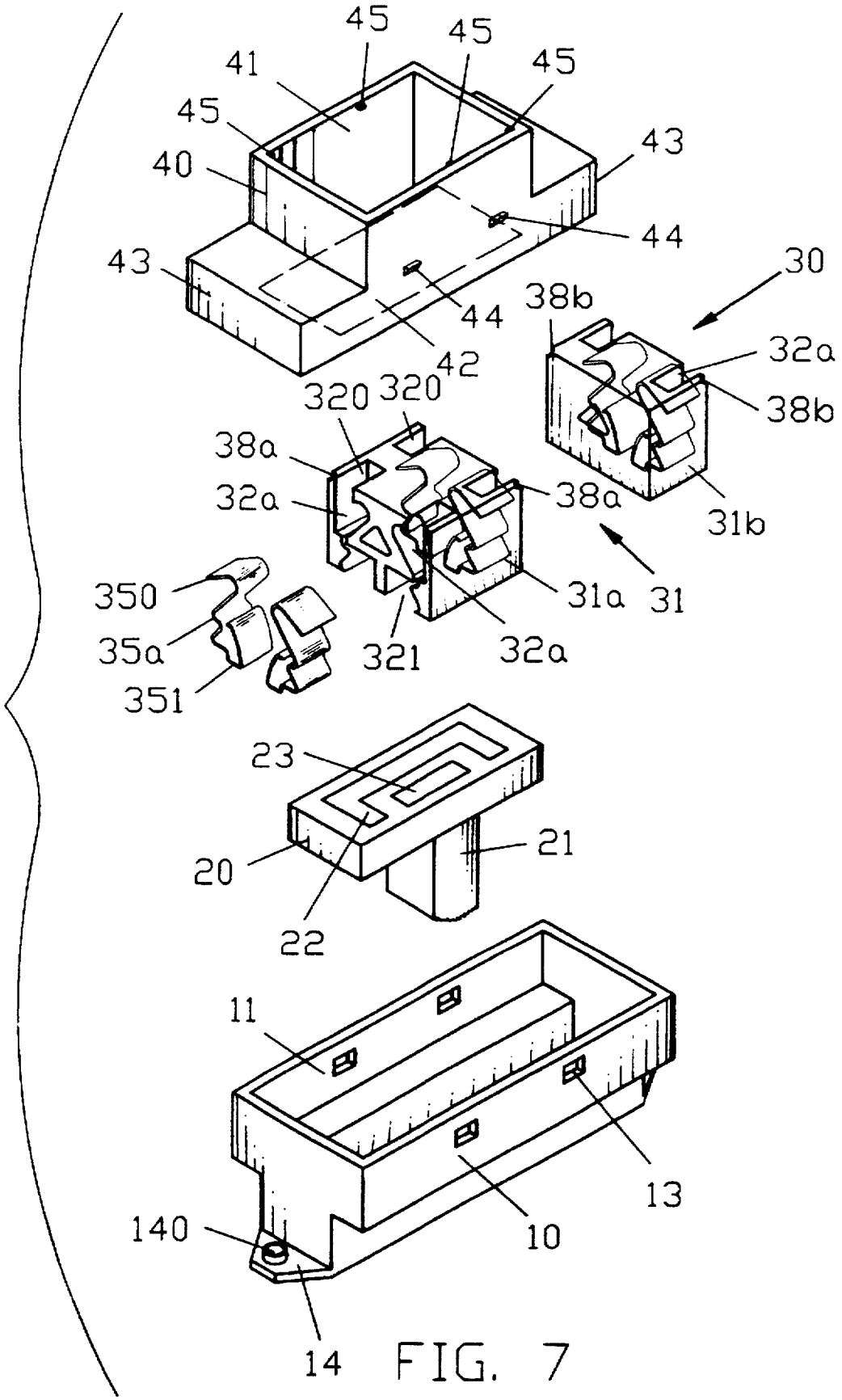
FIG. 7 is an exploded view of the electric connector assembly in FIG. 6.

The plug-in device 30 includes a positioning box 40 and a fixing seat 31. The positioning box 40 includes an upper open end 41 through which the fixing seat 31 may be inserted. The positioning box 40 further includes a step 43 formed on each of two sides thereof. In addition, a pair of hooks 44 are formed on each of two outer lateral walls of the positioning box 40, and a plurality of protrusions 45 are formed on an inner periphery of the positioning box. The fixing seat 31 comprises a first fixing block **31*a* and a second fixing block 31*b*, wherein the first fixing block 31*a* has two receiving compartments 32*a* defined in each of two sides thereof, and the second fixing block 31*b* has a receiving compartment 32*a* defined in each of two sides thereof, as shown in FIG. 7. The first fixing block 31*a* includes two notches 38*a* defined in two of four corners thereof, while the second fixing block 31*b* also includes two notches 38*b* defined in two of four corners thereof, the notches 38*a* and 38*b* receive the protrusions 45 on the inner periphery of the positioning box 40 when the first and second fixing blocks 31*a* and 31*b* are received in the positioning box 40. Six first accesses 320 are defined in an upper side of the fixing seat for being in communication with the receiving compartments 32*a***, respectively.

A conductive plate **35*a* is mounted in each of the receiving compartments 32*a*. As shown in FIG. 7, each conductive plate 35*a* includes a first end 350 bearing against a peripheral wall defining the receiving compartment 32*a* and a second end 351 which extends through a bottom wall defining the receiving compartment 32*a***.

Figure 8:
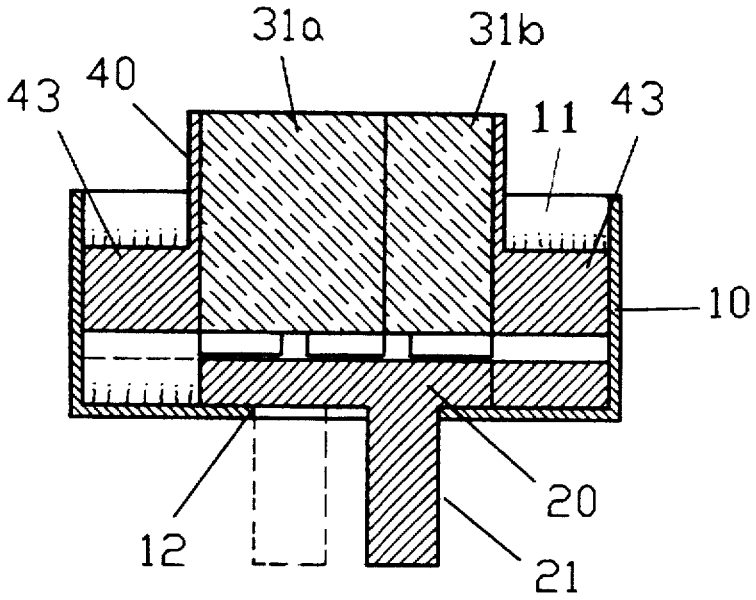
FIG. 8 is a cross sectional view taken along plane 8—8 in FIG. 6.
Figure 9:
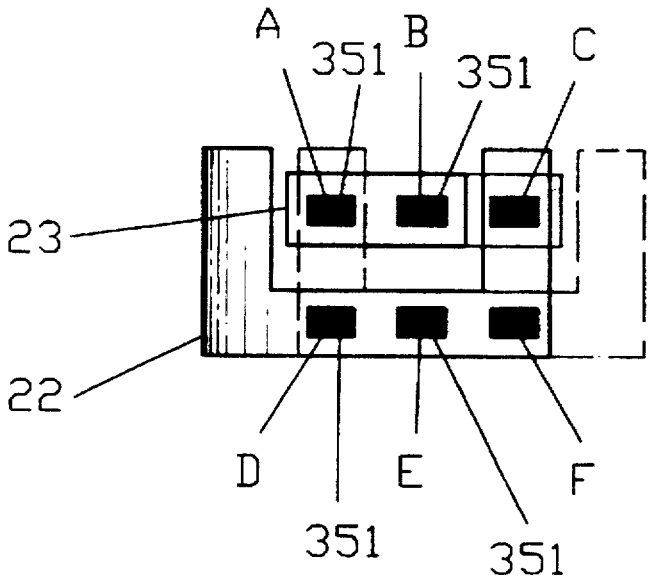
FIG. 9 is a schematic illustration of a switching operation of the electric connector assembly in FIG. 6.

Referring to FIGS. 7 to 9, a first conductive member 22 and a second conductive member 23 are mounted to an upper side of the slide block 20, wherein the first conductive member 22 is substantially U-shaped, and the second conductive member 23 is substantially rectangular (see FIG. 7). In addition, an operative rod 21 extends downwardly from an underside of the slide block 20.

In assembly, the conductive plates **35*a* are respectively mounted in the associated receiving compartments 32*a* of the first and second fixing blocks 31*a* and 31*b* such that the first end 350 of each conductive plate 35*a* bears against a peripheral wall defining the associated receiving compartment 32*a* and the second end 351 of each conductive plate extends through the bottom wall defining the associated receiving compartment 32*a*. Then, the first and second fixing blocks 31*a* and 31*b* are inserted into the positioning box 40 and positioned by means of engagement between the protrusions 45 and the notches 38*a* and 38*b*, thereby forming a complete plug-in device 30**

The slide block 20 is then mounted into a bottom of the housing 10 with the operative rod 21 extending through the slot 12 defined in the housing 10. Thereafter, the plug-in device 30 is inserted into the housing 10 at a position above the slide block 20 such that the second ends 351 of four conductive plates 35*a* are in electrical connection with the first conductive member 22, while the second ends 351 of the remaining conductive plates 35*a* are in electrical connection with the second conductive member 23, i.e., the contact "A" is in electric connection with the contact "B", while the contacts "C", "D", "E", and "F" are in electrical connection. Referring to FIG. 9, the contact "E" is always in electrical connection with the contact "F", i.e., switching only occurs between the contacts "A", "B", "C", and "D". The plug-in device 30 is securely retained in the housing 10 by means of the hooks 44*c* provided on each lateral wall of the plug-in device 30 snapping into the associated engaging slots 13 defined in the housing 10.

Referring to FIGS. 7 and 9, when a motor equipped with the second embodiment of the electric connector assembly of the present invention is intended to rotate in, e.g., a counterclockwise direction, the slide block 20 (via operation of the operative rod 21) is slid to a first position where the contact "A" is in electrical connection with the contact "B", while the contact "C" is in electrical connection with the contact "D".

When the motor is intended to rotate in a reverse direction, i.e. a clockwise direction, the slide block 20 (via operation of the operative rod 21) is slid to a second position where the contact "A" is in electrical connection with the contact "D", while the contact "B" is in electrical connection with the contact "C".

Again, when applied to a ceiling fan, free ends of the electric wires of the ceiling fan may be inserted into the receiving compartments 32*a* in sequence via the accesses 320 thereof, and then retained in position between the first end 350 of the conductive plates 35*a* and the peripheral wall defining the associated receiving compartments 32*a*. This can be accomplished by simple clipping of the free ends of the electric wires between the associated elements.

Figure 10:
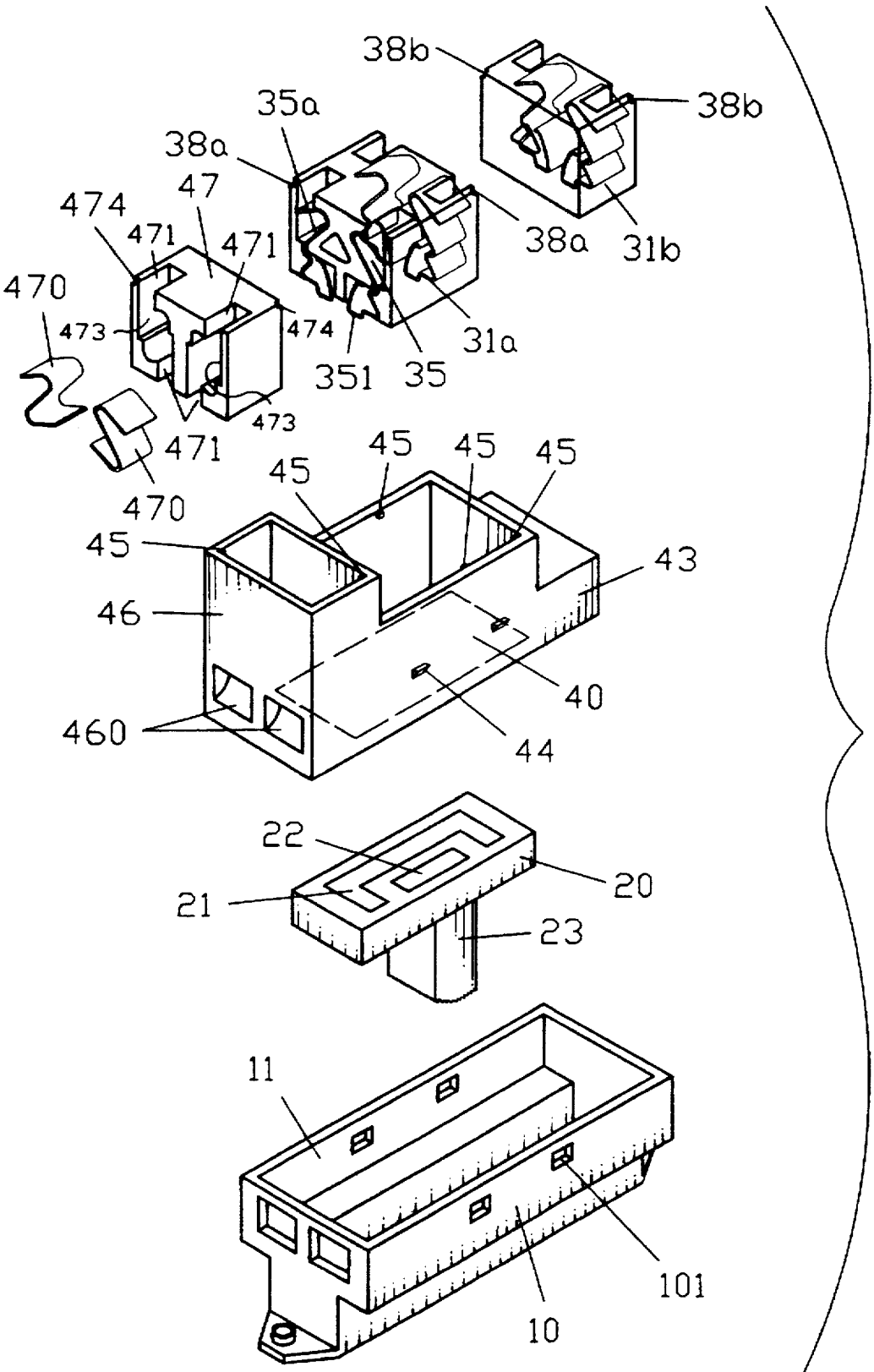
FIG. 10 is a perspective view illustrating a third embodiment of an electric connector assembly in accordance with the present invention.

Referring to FIG. 10, the positioning box 40 may have an extension box 46 extending from a side thereof. The extension box 46 is hollow for receiving an additional fixing block 47 via an open upper end thereof. In addition, the extension box 46 has a pair of slots 460 defined in a side wall thereof. The fixing block 47 includes two receiving compartments 473 each of which may receive a conductive plate 470 therein. The conductive plate 470 may be the same as the conductive plate 35 disclosed in the first embodiment. In addition, two spaced accesses 471 are defined in each of upper and lower sides of the extension box 46 such that external electric wires may extend through the accesses 471 (or the pair of slots 460 defined in the side wall of the extension box 46) into the associated receiving compartment 473 so as to be in electrical connection with the associated conductive plate 470, thereby providing additional contacts for power connection. Again, two protrusions 45 may be formed on an inner peripheral wall of the extension box 47, and the fixing block 47 may include two notches 474 defined in two of four corners thereof for receiving the protrusions 45, thereby providing a secure positioning effect.

Figure 11:
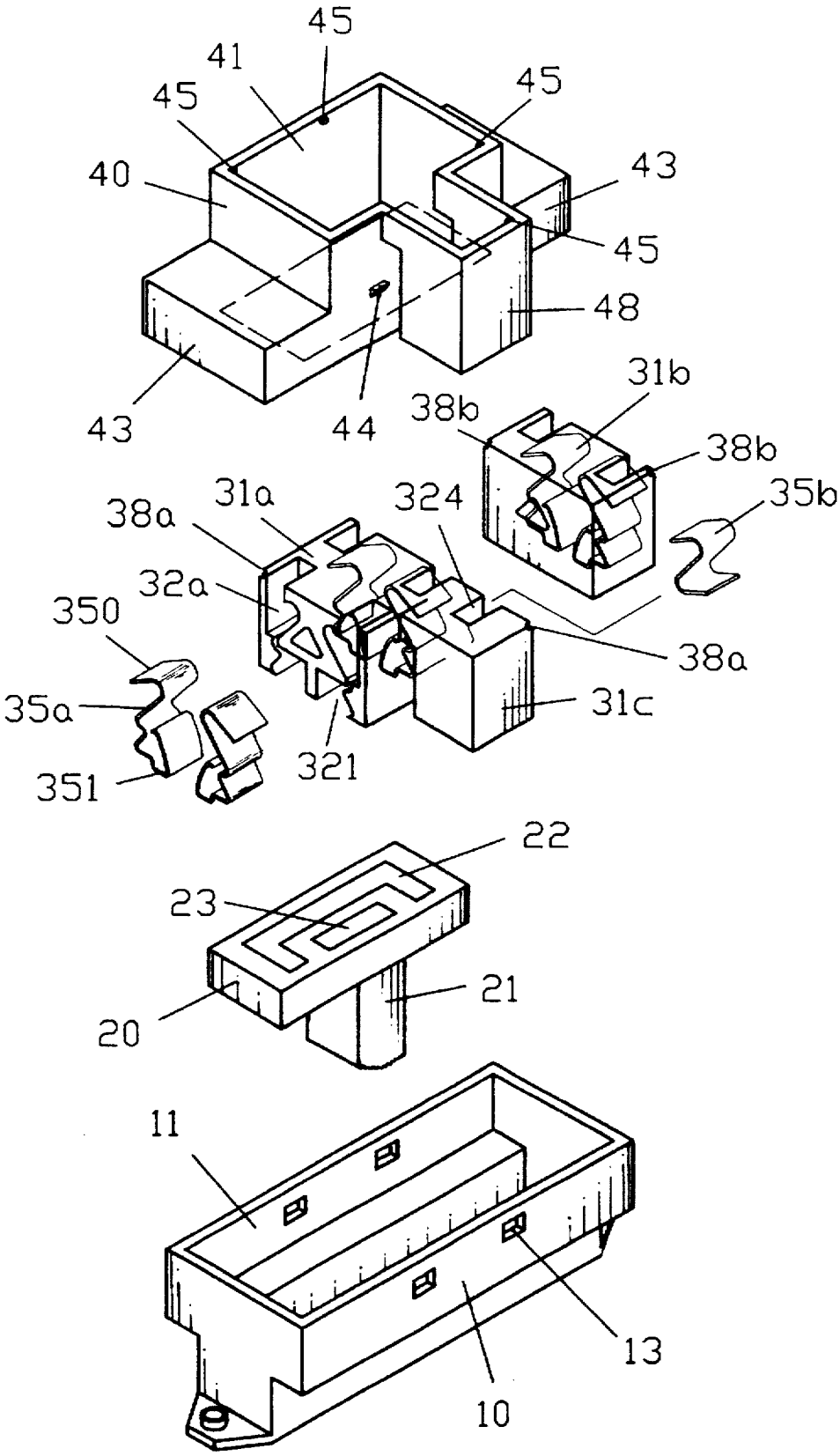
FIG. 11 is a perspective view illustrating a fourth embodiment of an electric connector assembly in accordance with the present invention.

Referring to FIG. 11, in this modified embodiment, an extension box 48 is provided to a mediate portion of a lateral side of the positioning box 40, and the fixing block 31*a* may have an extension block 31*c* extending from a lateral side thereof. The extension block 31*c* may be fittingly received in the extension box 48 and securely positioned by the provision of the protrusions 45, and notches 38*a* arrangement mentioned in the above. The extension block 31*c* further includes a receiving compartment (not labeled) for receiving an "S" shaped conductive plate 35*b* (identical to the conductive plate 35 in the first embodiment). In addition, an access 324 is defined in each of upper and lower sides of the extension block 31*c* such that an external electric wire may extend through the access 324 into the associated receiving compartment so as to be in electrical connection with the associated conductive plate 35*b*, thereby providing an additional contact for power connection.

Figure 12:
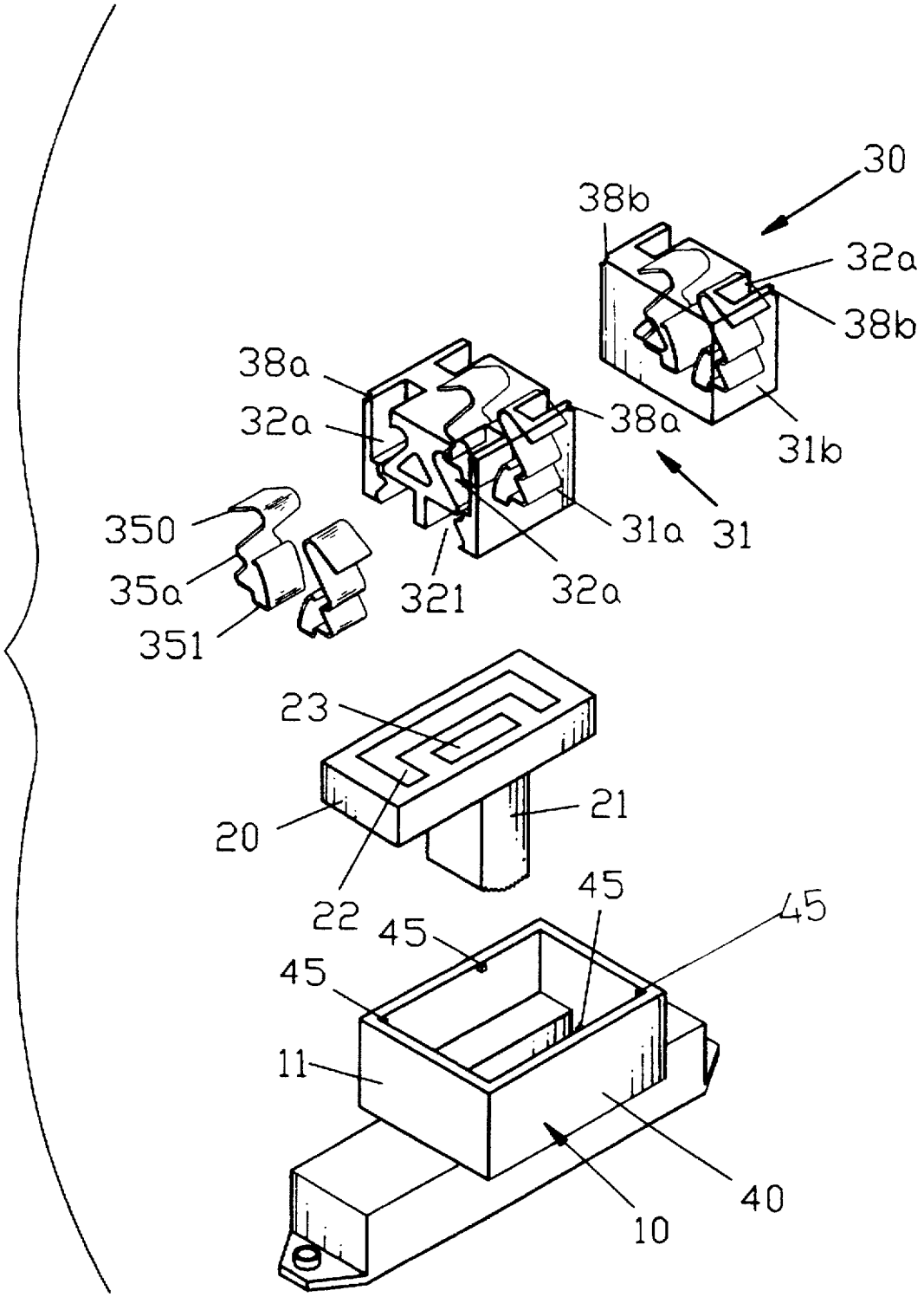
FIG. 12 is a perspective view illustrating a fifth embodiment of an electric connector assembly in accordance with the present invention.

Referring to FIG. 12, the positioning box 40 may be directly formed on top of the housing 10 for receiving the fixing blocks 31*a* and 31*b*.

Thus, the second embodiment and its modified embodiments provide simple structures, e.g., the number of the conductive members 22 and 23 is decreased, and the whole structure of the slide block 20 is simpler. This may lower the cost as the manufacture of the mold therefor is simpler. In addition, switch control can be achieved by a first conductive member 22 and a second conductive member 23 (the number of the conductive members 22 and 23 is decreased), i.e., the number of contacts is less than previous switch controls and thus provides a stable structure and prevents poor electrical connection therebetween. Furthermore, manufacture of the molds for the plug-in device is also simpler as the fixing seat 31 is separated into fixing blocks 31*a* and 31*b*. Accordingly, a high quality production is achieved.

Although the invention has been explained in relation to its preferred embodiment, it is to be understood that many other possible modifications and variations can be made without departing from the spirit and scope of the invention as hereinafter claimed.

What is claimed is:

1. An electric connector assembly, comprising:

a housing (10) including a slot (12) defined in a bottom thereof;

a slide block (20) mounted in the housing, the slide block including an operative rod (21) projecting downwardly from an underside thereof and extending through the slot of the housing, the slide block further including two separate first conductive members (22) and two separate second conductive members (23) mounted to an upper side thereof; and a plug-in device (30) mounted in the housing at a position above the sliding block, the plug-in device including:

a fixing seat (31) having two first receiving compartments (32) and at least one second receiving compartment (33) defined in each of two sides thereof, the fixing seat further including four first accesses (320) and at least two second accesses (330) defined in an upper side thereof which are in communication with the first receiving compartments and the second receiving compartments, respectively, a first conductive plate (34) mounted in each said first receiving compartment, a second conductive plate (35) mounted in each said second receiving compartment, and a third conductive plate (36) mounted in the housing for electrically interconnecting one said second conductive plate and an associated first conductive plate disposed in an adjacent first receiving compartment;

wherein said associated first conductive plate includes a first end (340) attached to the third conductive plate and a second end (341) which extends through a bottom wall defining the associated first receiving compartment (32) and bearing against the bottom wall defining the associated first receiving compartment, and wherein the second ends (341) of the first conductive plates (34) are selectively in electrical connection with one of the first conductive members (22) and the second conductive members (23) upon manual operation of the sliding block via the operative rod (23).

2. The electric connector assembly according to claim 1, wherein the housing includes a plurality of engaging slots (13) defined in an upper end of each of two lateral walls thereof, and the fixing seat (31) includes a plurality of hooks (31) formed on two lateral sides thereof for being securely received in the engaging slots.

3. The electric connector assembly according to claim 1, wherein the bottom wall defining each said first receiving compartment includes a recess (322) defined therein, and said second end of each said first conductive plate includes a hook end which is retained in the recess.

4. The electric connector assembly according to claim 1, wherein the first conductive members are substantially U-shaped and disposed in mirror image, and the second conductive members are substantially rectangular and disposed in parallel relationship one with respect to another.

* * * * *